US006644924B1

(12) United States Patent
Frolov et al.

(10) Patent No.: US 6,644,924 B1
(45) Date of Patent: Nov. 11, 2003

(54) COVERS FOR TURBINE BUCKETS AND METHODS OF ASSEMBLY

(75) Inventors: Boris I. Frolov, Moscow (RU); Anil K. Tolpadi, Niskayuna, NY (US); Gregory Lee Landry, Glenburn, ME (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/158,229

(22) Filed: May 31, 2002

(51) Int. Cl.[7] ..... F01D 5/22
(52) U.S. Cl. ..... 416/191; 416/214 R
(58) Field of Search ..... 415/191, 196, 415/209.2, 209.4, 210.1; 416/191, 210 R, 214 R, 222

(56) References Cited

U.S. PATENT DOCUMENTS 6,454,534 B1 * 9/2002 Burnett et al. ..... 416/190

FOREIGN PATENT DOCUMENTS

JP 52109006 A * 9/1977 ..... F01D/11/08
JP 05106404 A * 4/1993 ..... F01D/5/26

* cited by examiner

*Primary Examiner*—Edward K. Look
*Assistant Examiner*—Dwayne J. White
(74) *Attorney, Agent, or Firm*—Nixon & Vanderhye

(57) ABSTRACT

A bucket cover includes circumferentially disposed arcuate cover segments each having discrete arcuate inner, intermediate and outer cover elements for spanning the tips of a plurality of turbine buckets. Each segment includes circumferentially spaced radial openings through the elements for receiving the tenons at the bucket tips. The intermediate element has a cavity or recess formed between circumferentially spaced webs which define the openings through the intermediate element for weight reduction purposes. In final assembly, the tips of the tenons are automatically peened to retain the elements on the buckets and excess material is machined to provide a smooth, continuous arcuate, circumferentially extending outer surface. The cavities are bounded by the webs, forward and rear end walls and the inner and outer surfaces of the outer and inner elements, respectively.

14 Claims, 3 Drawing Sheets

COVERS FOR TURBINE BUCKETS AND METHODS OF ASSEMBLY

BACKGROUND OF THE INVENTION

The present invention relates to a multiple-layered bucket cover for turbines and particularly relates to a multi-layered bucket cover having an intermediate perforated layer and methods of assembly.

A turbine rotor typically mounts a plurality of circumferentially spaced, generally radially extending airfoils or buckets. Covers are conventionally provided on the tips of the buckets, the covers forming a 360° annulus about the buckets with a small clearance between the outer surface of the cover and the surrounding shroud.

There are a number of different structures and methods for securing covers to the tips of the buckets. One such structure is known as a button tenon/cover configuration. In that construction, one or more tenons projecting generally radially from each bucket pass through corresponding openings in the cover and are peened, preferably automatically, along the outer surface of the cover. This button tenon/cover configuration provides substantial pull strength, i.e., sufficient structural integrity between the cover and bucket, to preclude removal of the cover from the end of the bucket under centrifugal forces. The button tenon/cover configuration, however, does not provide adequate cover sealing. That is, the buttons form a series of radially outward projections along the outer surface of the cover, necessitating increased clearance between the rotating component, i.e., the covers, and the surrounding stationary component, i.e., a shroud, thereby increasing tip leakage losses. The button tenon/cover configuration, however, has the advantage of enabling the peening operation to be performed automatically.

In another configuration, known as a "foxhole" tenon/cover configuration, the tenon on the bucket is recessed from the outer opening of the cover. Because of the absence of buttons projecting beyond the outer surface of the cover, the "foxhole" configuration enables tighter tip clearance with the surrounding stationary component, affording improved cover sealing and reduced tip leakage losses. However, foxhole tenon/cover configurations require a manual peening process to secure the covers to the buckets. This process is physically laborious and costly. Accordingly, there is a need to provide a bucket cover which affords sufficient pull strength and which can be both automatically peened and provide adequate cover sealing to minimize tip leakage losses.

BRIEF DESCRIPTION OF THE INVENTION

In accordance with a preferred embodiment of the present invention, there is provided a bucket cover formed of multiple layers or elements in an arcuate configuration spanning the outer tip of the buckets. The bucket cover is provided in multiple arcuate segments forming a complete annulus about the periphery of the rotor, each segment comprised of multiple elements. Preferably, each bucket cover segment includes an inner element, an outer element and intermediate element for disposition between the inner and outer elements. The segments, and hence the elements, may span three or more buckets and are fitted on tenons of the buckets.

Particularly, the elements are provided with circumferentially spaced openings in registration with one another for receiving the tenons on the ends of the buckets. It will be appreciated that the tenons have a reduced profile as compared with the airfoil profile of the buckets. A radius or chamfer is provided between the reduced profile of the tenon and the airfoil profile at the tip of the bucket. Each opening through the inner element has a radial inwardly increasing chamfer to overlie the radiussed portion at the juncture between the tenon and the bucket airfoil. The intermediate element has openings corresponding to the profile of the tenon. The outer element has openings having a radially outwardly directed chamfer. The inner, intermediate and outer elements are disposed sequentially on the buckets with the openings receiving the tenons. Projecting ends of the tenons may then be peened, preferably automatically, to secure the elements to the buckets. Any excess material of the tenons is removed, for example, by machining to provide a smooth, continuous surface along the outer circumference of the cover. In this manner, tight clearances can be maintained between the cover and the surrounding stationary component.

To provide the necessary pull strength, cavities are provided in the intermediate elements between adjacent tenons. The cavities are void of material but are closed by end walls of the intermediate element facing upstream and downstream directions of hot gas flow through the turbine and bounded by the outer and inner surfaces of the inner and outer elements, respectively. In this manner, a considerable weight reduction in the cover is effected and hence any tendency of the covers for displacement radially outwardly due to centrifugal force is minimized and significantly reduces the pull strength. While the cover elements can be radially aligned with one another at their circumferentially adjacent joints, the elements may also be staggered relative to one another such that the joints between circumferential adjacent elements are misaligned or staggered in a circumferential direction relative to one another.

By utilizing the foregoing described configuration, a flush tenon/cover configuration having adequate pull strength is provided which advantageously can be formed using automatic peening machinery. Simultaneously, cover sealing is improved by tightening clearances between the cover annulus and the surrounding shroud.

In a preferred embodiment according to the present invention, there is provided a cover for a turbine bucket having a tenon adjacent a tip of the bucket comprising discrete inner and outer arcuate cover elements and an intermediate arcuate cover element therebetween, the elements having generally radially aligned openings for receiving the bucket tenon, the outer element having a radially outward chamfer for receiving peened bucket tenon material to retain the elements on the bucket.

In a further preferred embodiment according to the present invention, there is provided a rotatable component for a turbine comprising a plurality of circumferentially spaced buckets rotatable about an axis and terminating in radially outwardly extending tenons, a cover for the buckets including a plurality of discrete arcuate cover segments, each segment having inner, outer and intermediate arcuately extending elements, the elements having generally radially aligned openings at circumferentially spaced locations along the segments for receiving tenons, the tenons being peened to secure the elements on the buckets and forming a generally smooth continuous outer surface with an outer surface of the outer element.

In a further preferred embodiment according to the present invention, there is provided a method of assembling covers on buckets of a rotary component of a turbine, including the steps of providing inner, outer and intermediate arcuate cover elements having openings therethrough for receiving tenons formed on the ends of the buckets, locating the inner, intermediate and outer cover elements in succession on the tenons of the buckets with ends of the tenons projecting from the outer element, peening projecting ends of the tenons to secure the elements to the buckets and providing a smooth continuous arcuate surface along the outer surface of the cover including along the peened ends of the tenons.

DETAILED DESCRIPTION OF THE INVENTION

Figure 1:
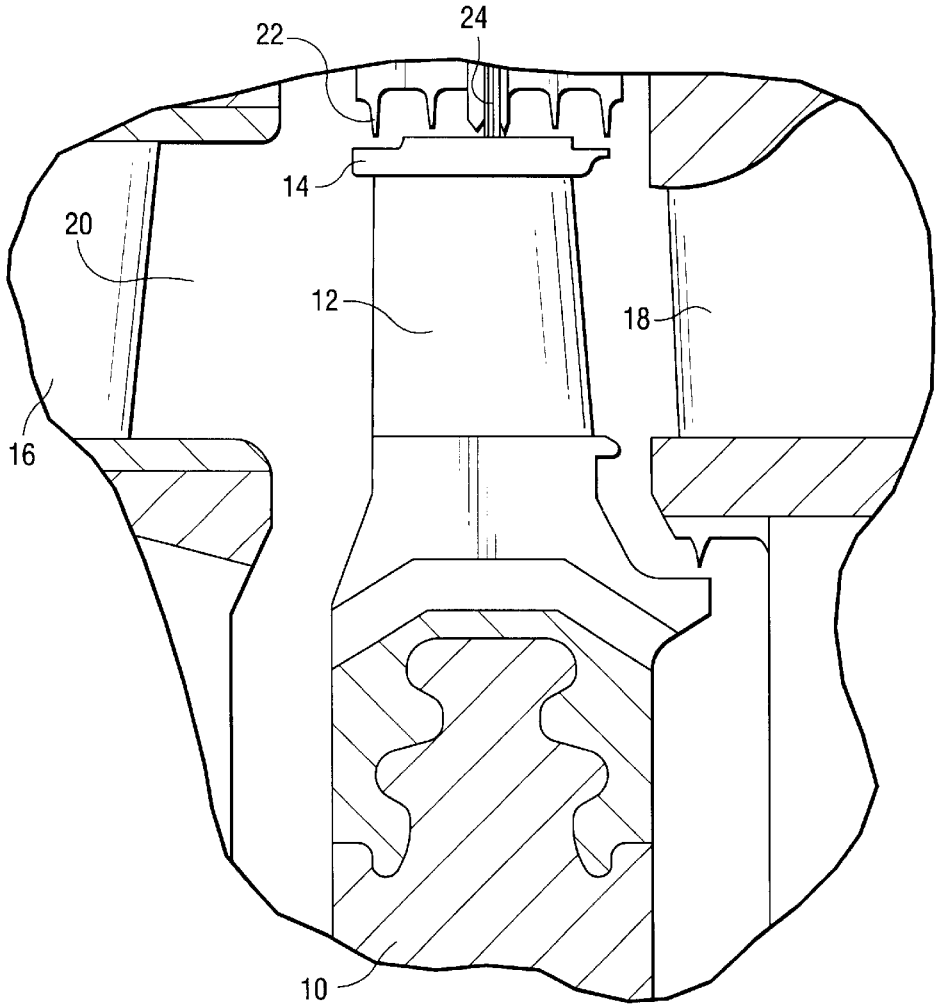
FIG. 1 is a fragmentary cross-sectional view of a portion of a turbine illustrating a turbine rotor with buckets and a cover and associated turbine stator stages.

Referring now to the drawings, particularly to FIG. 1, there is illustrated a rotor 10 mounting a plurality of circumferentially spaced buckets, one of which is illustrated at 12, having a bucket cover 14. Axially adjacent stator vanes 16 and 18 of the fixed component of the turbine are also disclosed in the turbine flowpath 20. Labyrinth-type seals 22, as well as a brush seal 24, are illustrated for sealing about the covers 14 during operation of the turbine.

Figure 2:
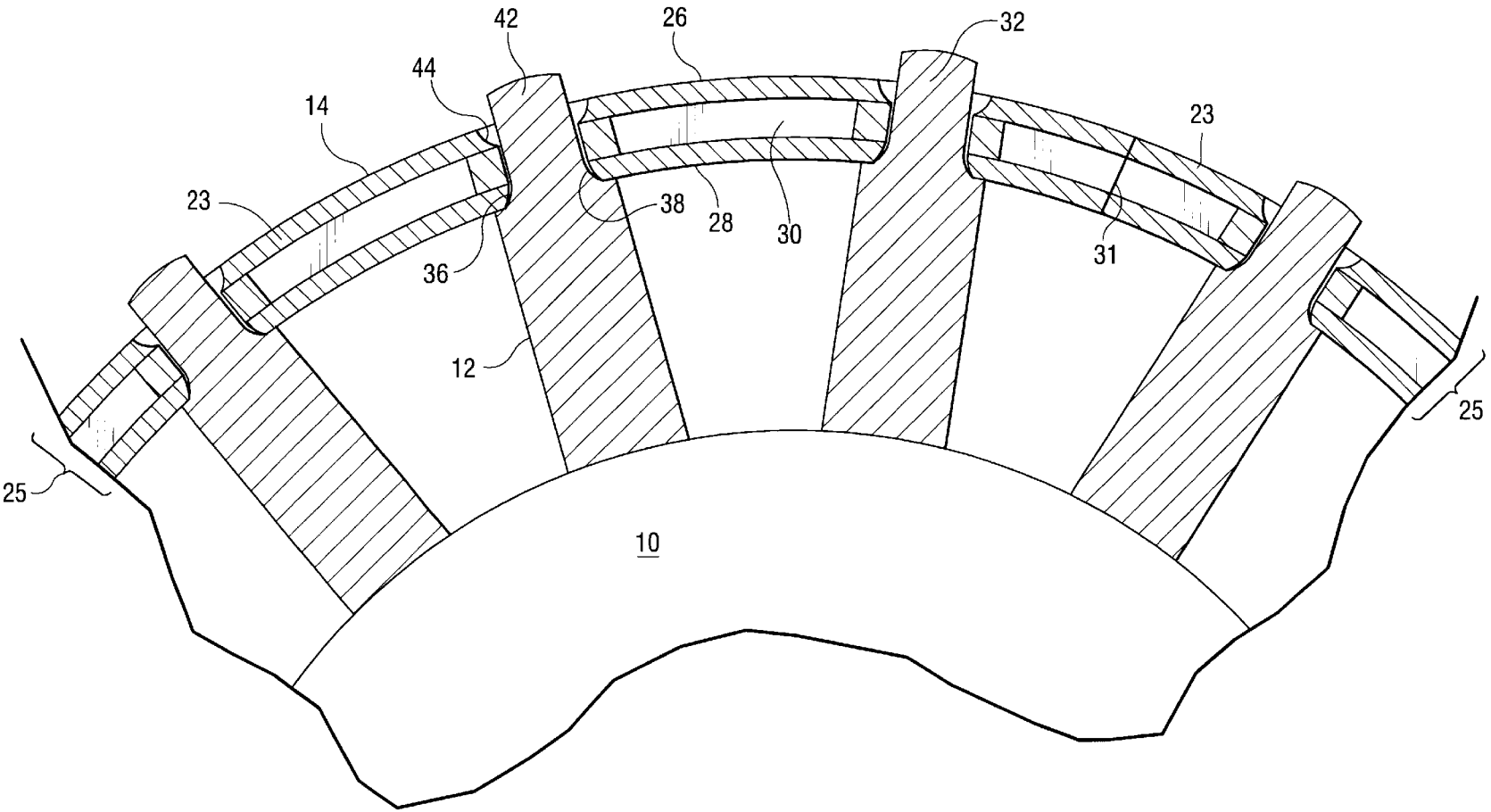
FIG. 2 is a schematic fragmentary axial cross-sectional view illustrating application of the multiple-layer bucket cover of the present invention on the tenons of the buckets of the rotor.

Referring now to FIG. 2, the cover 14 includes a plurality of arcuate cover segments 23, each comprised of cover layers or elements, collectively identified at 25. As illustrated, the collective cover elements 25 of each segment 23 include an arcuately extending outer element 26, an inner cover element 28 and an intermediate cover element 30. The cover elements 26, 28 and 30 extend arcuately and span a plurality of buckets 12, for example, four to twenty buckets, depending upon the stage. The arcuate cover segments are secured on tenons 32 formed on the tip of each of the buckets 12. The cover segments 23 butt adjoining cover elements at opposite ends in a circumferential direction at locations between the buckets to form a complete annulus about the buckets 12. Likewise, each of the outer, inner and intermediate elements 26, 28 and 30, respectively, butt one another in a circumferential direction. Thus, the joints 31 between the segments 23 have their inner, intermediate and outer elements aligned in a radial direction with one another. Alternatively, the elements may be staggered in a circumferential direction relative to one another whereby the joints between the corresponding elements 26, 28 and 30 are staggered circumferentially relative to one another.

Figure 4:
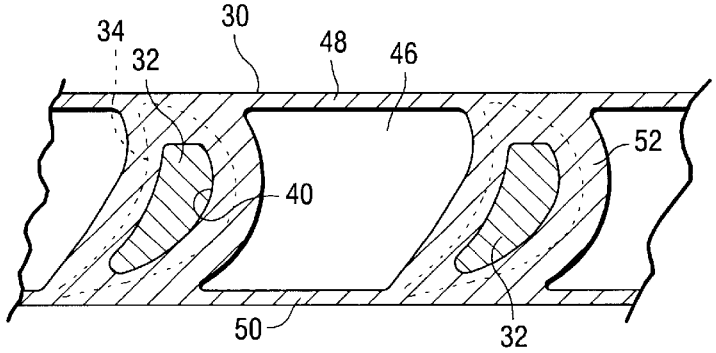
FIG. 4 is a cross-sectional view taken generally about on line 4—4 in FIG. 3.

As illustrated in FIG. 2, the buckets 12 terminate at their outer tips in tenons 32. Each of the cover elements 26, 28 and 30 has openings at circumferentially spaced positions to receive the tenons 32. As illustrated in FIG. 4, the tenons 32 are reduced in cross-sectional configuration from that of the bucket airfoil shape illustrated at 34 in FIG. 4 by the dashed lines. Each tenon 32 also terminates short of both the leading and trailing edges of the corresponding bucket. Their side surfaces also lie inwardly of the suction and pressure sides of the airfoil surfaces of buckets 12.

As illustrated in FIG. 2, the juncture of the tenons 32 and the radial outer end of the airfoils of the buckets 12 are radiussed or chamfered as indicated at 36. The openings 38 through the inner element 28 are also radiussed for engagement with the radii 36 at the juncture of the tenons and bucket airfoils. As illustrated in FIG. 4, the intermediate element 30 includes circumferentially spaced openings 40 in the general shape of, and for receiving the tenons 32. Referring back to FIG. 2, the openings 42 through the outer elements 26 are also radiussed to provide generally concave surfaces 44 about the tenons 32. It will be appreciated that each of the cover elements 26, 28 and 30 comprises discrete elements which are separately and sequentially applied to the tenons 32 of the buckets 12 during their assembly onto the rotor 10.

Figure 3:
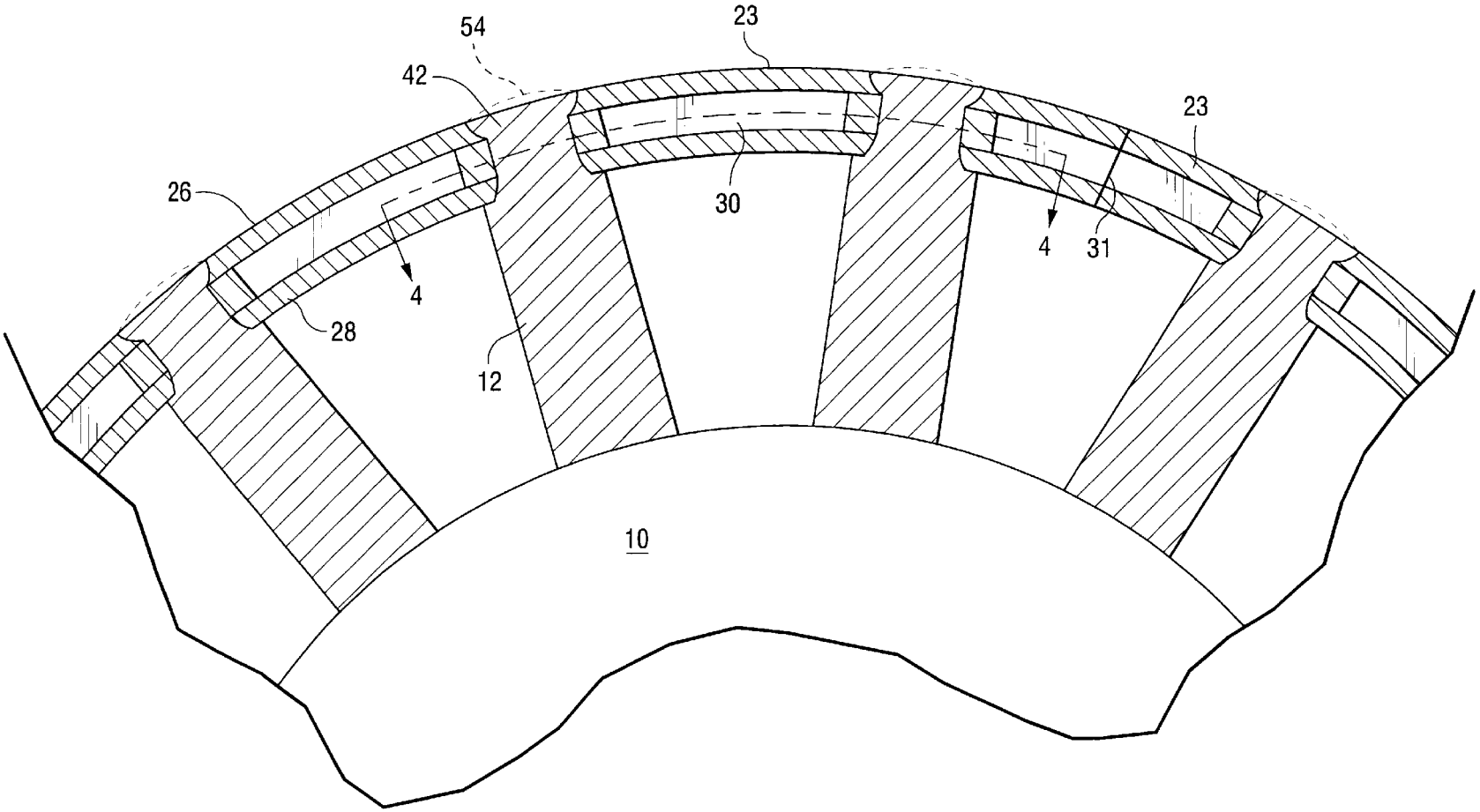
FIG. 3 is a view similar to FIG. 2 illustrating the completed bucket cover assembly.

As best illustrated in FIGS. 2, 3 and 4, the intermediate element 30 also includes cavities 46 at spaced circumferential locations about the cover 12. Preferably, each cavity 46 opens radially outwardly and inwardly of the intermediate element 30. It will be appreciated, however, that the intermediate element may have a cavity formed therein rather than a cavity formed through the element. The cavity 46 is bounded by end walls 48 and 50 and also by margins of adjacent webs 52. Each web 52 spans between the end walls 48 and 50, the webs 52 surrounding the openings 40 receiving tenons 32. The end walls 48 and 50 face upstream or downstream flow directions along the turbine flowpath. In assembly, it will also be appreciated that the cavity 46 is bounded by the inner and outer surfaces of the outer and inner elements 26 and 28, respectively. In final assembly, it will therefore be appreciated that each of the cavities 46 along the cover and between the buckets is entirely closed.

To assemble the cover onto the rotor 10 and particularly on the tips of the buckets, the inner, intermediate and outer elements of each cover segment 23 are disposed on the tenons 32 in sequence. Once located on the tenons, as illustrated in FIG. 2, the tenons may be peened. Because the tenons project outwardly of the outer surface of each outer cover element 26, the tenons may be peened by automatic machinery. During peening, the material of the tenons is deformed to expand laterally to fill the space between the tenons and the margins of the openings through the elements 26, 28 and 30. Particularly, the deformed material fills the radius or concave openings 44 about the openings through the outer cover element 26. Because the material is deformed by the peening operation into the enlarged area of the openings through the outer cover element 26, the inner, intermediate and outer elements, which are stacked one against the other, are secured to the buckets 12 about the tenons 32.

As illustrated in FIG. 3, the peening operation will result in a small button, indicated 54 in FIG. 3, along the outer surface of the outer element. These buttons, which are formed by excess material of the tenons, are then machined off to provide a smooth, continuous outer arcuate surface about the annular cover. That is, the outer surface of the tenon conforms to the arcuate circumferential shape of the covers.

With the foregoing construction, it will be appreciated that cover sealing is provided with reduced tip leakage losses because tight clearances can be maintained between the outer surface of the cover and the surrounding shroud or seal surfaces. While generally flush tenon/cover configurations do not provide adequate pull strength, i.e., there is insufficient strength to maintain the cover on the buckets during high centrifugal loads, the flush tenon/cover configuration of the present invention has substantial pull strength because of the reduction in weight of the cover afforded by the formation of the cavities 46 in the intermediate elements 30. With this configuration, it will therefore be appreciated that the pull strength requirements are met. Importantly, the tenons can be automatically peened and provide tight cover sealing due to the flush tenon/cover design. The perforated cover design meets these requirements.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cover for a turbine bucket having a tenon adjacent a tip of the bucket comprising:

discrete inner and outer arcuate cover elements and an intermediate arcuate cover element therebetween, said elements having generally radially aligned openings for receiving the bucket tenon, said outer element having a radially outward chamfer for receiving peened bucket tenon material to retain said elements on the bucket.

2. A cover according to claim 1 wherein said elements extend arcuately about a plurality of adjacent bucket and have radially aligned openings at circumferentially spaced locations for receiving respective bucket tenons, said intermediate cover element having a cavity between said outer and inner elements and between adjacent tenons.

3. A cover according to claim 2 wherein said cavity has axially closed opposite end walls.

4. A cover according to claim 1 wherein said elements extend arcuately about a plurality of adjacent buckets, said intermediate element having a cavity extending between adjacent buckets.

5. A cover according to claim 4 wherein said intermediate element has axially opposed end walls closing said cavity, said cavity being defined in part by the inner and outer elements and said end walls.

6. A cover according to claim 1 wherein said outer element has a radially outwardly extending chamfered surface, said inner element having a radially inwardly extending chamfered surface.

7. A rotatable component for a turbine comprising:

a plurality of circumferentially spaced buckets rotatable about an axis and terminating in radially outwardly extending tenons;

a cover for said buckets including a plurality of discrete arcuate cover segments, each segment having inner, outer and intermediate arcuately extending elements, said elements having generally radially aligned openings at circumferentially spaced locations along the segments for receiving tenons, said tenons being peened to secure the elements on the buckets and forming a generally smooth continuous outer surface with an outer surface of said outer element.

8. A component according to claim 7 wherein each said intermediate element includes a cavity therein between adjacent tenons.

9. A component according to claim 8 wherein each said cavity is defined by margins of said intermediate element, inner and outer surfaces of said outer and inner elements, respectively, and axially opposite end walls of said intermediate element.

10. A component according to claim 7 wherein said openings through said inner and outer elements are chamfered in opposite directions.

11. A method of assembling covers on buckets of a rotary component of a turbine, including the steps of:

providing inner, outer and intermediate arcuate cover elements having openings therethrough for receiving tenons formed on the ends of the buckets;

locating the inner, intermediate and outer cover elements in succession on the tenons of the buckets with ends of the tenons projecting from the outer element;

peening projecting ends of the tenons to secure the elements to the buckets; and providing a smooth continuous arcuate surface along the outer surface of the cover including along the peened ends of the tenons.

12. A method according to claim 11 including forming a cavity in said intermediate element between adjacent openings thereof.

13. A method according to claim 12 including forming a cavity through said intermediate elements between the adjacent openings.

14. A method according to claim 13 including forming a cavity through said intermediate elements such that the cavity is bounded by inner and outer surfaces of the outer and inner elements, respectively, axially opposite end walls of said intermediate element, and circumferentially opposed webs of said intermediate element forming said end walls to one another.

* * * * *